US011041277B2

(12) United States Patent
Chiodo et al.

(10) Patent No.: US 11,041,277 B2
(45) Date of Patent: Jun. 22, 2021

(54) APPARATUS AND METHOD FOR INFRARED HEATING OF ASPHALT

(71) Applicant: SMART FIX ASPHALT INFRARED REPAIR LTD., Edmonton (CA)

(72) Inventors: Vitto Chiodo, Edmonton (CA); Hans Gostman, Edmonton (CA)

(73) Assignee: SMART FIX ASPHALT INFRARED REPAIR LTD., Edmonton (CA)

( * ) Notice: Subject to any disclaimer, the term of this patent is extended or adjusted under 35 U.S.C. 154(b) by 128 days.

(21) Appl. No.: 15/924,685

(22) Filed: Mar. 19, 2018

(65) Prior Publication Data

US 2018/0274186 A1 Sep. 27, 2018

Related U.S. Application Data

(60) Provisional application No. 62/473,119, filed on Mar. 17, 2017.

(51) Int. Cl.
*E01C 23/14* (2006.01)
*E01C 11/00* (2006.01)
*F23D 14/12* (2006.01)

(52) U.S. Cl.
CPC ..... *E01C 23/14* (2013.01); *E01C 11/005* (2013.01); *F23D 14/125* (2013.01); *E01C 2301/10* (2013.01)

(58) Field of Classification Search
CPC ..... E01C 23/14; E01C 2301/10
USPC ..... 404/95
See application file for complete search history.

(56) References Cited

U.S. PATENT DOCUMENTS 3,311,104 A * 3/1967 Wollner ..... E01C 23/14 126/92 R
3,857,670 A 12/1974 Karlovetz et al.
5,218,952 A 6/1993 Neufeldt
6,371,689 B1 * 4/2002 Wiley ..... E01C 23/065 404/77
6,669,467 B2 * 12/2003 Kieswetter ..... F23D 14/145 126/92 AC
9,624,624 B2 * 4/2017 Filion ..... E01C 7/187
2003/0213485 A1 11/2003 Kieswetter

FOREIGN PATENT DOCUMENTS

WO 2010100401 9/2010

* cited by examiner

*Primary Examiner* — Gary S Hartmann
(74) *Attorney, Agent, or Firm* — Bennett Jones LLP

(57) ABSTRACT

An apparatus for heating asphalt is used with a container storing a gaseous fuel under pressure. The apparatus includes one or more heaters, each of which includes an elongate infrared emitter, an elongate burner tube, and a Venturi tube. The infrared emitter includes an elongate emitter surface for emitting infrared radiation at the material when the infrared emitter is heated. The burner tube is coupled to the infrared emitter, and defines a burner tube interior for distributing an air-fuel mixture to a plurality of burner tube apertures for distributing the air-fuel mixture over a burner tube outer surface disposed opposite to and spaced apart from the infrared emitter. The Venturi tube is for mixing the fuel from the container with air to create the air-fuel mixture, and supplying the air-fuel mixture to the burner tube interior.

16 Claims, 6 Drawing Sheets

APPARATUS AND METHOD FOR INFRARED HEATING OF ASPHALT

CROSS-REFERENCE TO RELATED APPLICATIONS

This application claims priority to U.S. provisional patent application No. 62/473,119 filed on Mar. 17, 2017, the entire contents of which are hereby incorporated in this application where permitted.

FIELD OF THE INVENTION

The present invention relates to apparatuses and methods for infrared heating of a material, as may be used in repair and restoration of asphalt pavement.

BACKGROUND OF THE INVENTION

Conventional asphalt pavement repair uses jackhammers and pavement cutting saws to remove damaged pavement, catch-basin surrounds, pavement deficiencies, and potholes. The spoiled material must then be disposed of, and new hot-mix asphalt installed for the entire area and volume under repair.

It is known to use heaters, including infrared heaters, to heat asphalt in a repair job. However, existing infrared equipment suffers from lack of combustion efficiency, including difficulties with optimization of the flame envelope and conversion from flame heat to infrared energy. As a result, conventional infrared heaters have a large fuel requirement, with an attendant large carbon usage footprint.

In the past, labor cost, fuel prices, asphalt material costs, transportation costs/disruption were less pressing, and any method of heating the pavement material was acceptable, irrespective of damage to the asphalt binder or how much damaged material had to be removed and disposed of. However, as costs of repair have escalated, the spectrographic footprint of binder composition, as well as its rheological, chemical, and mechanical properties, have significant impact on the life-cycle costs of roads, highways and capital infrastructure.

Therefore, there is a need in the art for an asphalt repair system and method which may mitigate some or all of the difficulties of the prior art.

SUMMARY OF THE INVENTION

In one aspect, the present invention comprises an apparatus for heating asphalt. The apparatus may be used when repairing an existing asphalt pavement, and in the construction of a new asphalt pavement.

The apparatus is used with a container storing a gaseous fuel under pressure. The apparatus comprises at least one heater. Each heater comprises an elongate infrared emitter, an elongate burner tube, and a Venturi tube. The infrared emitter comprises an elongate emitter surface for emitting infrared radiation at the material when the infrared emitter is heated. The burner tube is coupled to the infrared emitter, and defines a burner tube interior for distributing an air-fuel mixture to a plurality of burner tube apertures for distributing the air-fuel mixture over a burner tube outer surface disposed opposite to and spaced apart from the infrared emitter. The Venturi tube is for mixing the fuel from the container with air to create the air-fuel mixture, and supplying the air-fuel mixture to the burner tube interior.

In an embodiment of the apparatus, the infrared emitter comprises a matrix of metallic fibers, which may comprise an alloy comprising nickel, chromium, and iron, such as Inconel™.

In an embodiment of the apparatus, the apparatus further comprises a support member for supporting the matrix of metallic fibers, wherein the support member is disposed between the burner tube outer surface and the matrix of metallic fibers, and defines a plurality of support member apertures permitting gas flow from the burner tube outer surface to the infrared emitter. The support member may comprise an expanded metal sheet.

In an embodiment of the apparatus, the Venturi tube supplies the air-fuel mixture to the burner tube interior through an end opening of the burner tube. In an embodiment of the apparatus, the Venturi tube supplies the air-fuel mixture to the burner tube interior through an opening of the burner tube between the ends of the burner tube.

In an embodiment of the apparatus, the apparatus further comprises a baffle disposed in the burner tube interior.

In an embodiment of the apparatus, the at least one heater comprises a plurality of heaters. The elongate emitter surfaces may be arranged parallel to each other along their lengthwise direction, and spaced apart from each other in the widthwise direction. The elongate emitter surfaces may be arranged in line and in end-to-end relationship with each other along their lengthwise direction.

In an embodiment of the apparatus, the apparatus further comprises an induction tube for supplying intake air to the burner tube interior, wherein, in use, the induction tube is heated by waste-heat radiated from the burner tube to pre-heat the intake air supplied to the burner tube interior.

In an embodiment of the apparatus, the apparatus further comprises a reflector for adjusting a view factor of the emitter surface.

In another aspect, the present invention comprises a method for heating asphalt. The method comprises the steps of: supplying a gaseous fuel stored under pressure in a container and air through a Venturi tube to create an air-fuel mixture in a burner tube interior; distributing the air-fuel mixture from the burner tube interior through burner tube apertures over a burner tube outer surface disposed opposite to and spaced apart from an infrared emitter; and combusting the distributed air-fuel mixture to heat the infrared emitter, whereupon an emitter surface of the infrared emitter emits infrared radiation at the asphalt.

In an embodiment of the method, the method further comprises the step of regulating a pressure at which the fuel is supplied from the container to the Venturi tube.

In an embodiment of the method, the infrared emitter comprises a matrix of metallic fibers, which may comprise an alloy comprising nickel, chromium, and iron.

In an embodiment of the method, the infrared emitter is heated to a temperature of at least about 1800 degrees Fahrenheit.

In an embodiment of the method, the method further comprises the step of pre-heating intake air supplied to the burner tube interior with waste-heat radiated from the burner tube.

In an embodiment of the method, the method further comprises the step of using a reflector for adjusting a view factor of the emitter surface.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

DETAILED DESCRIPTION OF THE INVENTION

As used herein, defined terms have the meanings given in this specification. All other terms and phrases used in this specification have their ordinary meanings as one of skill in the art would understand.

Apparatus.

Figure 1:
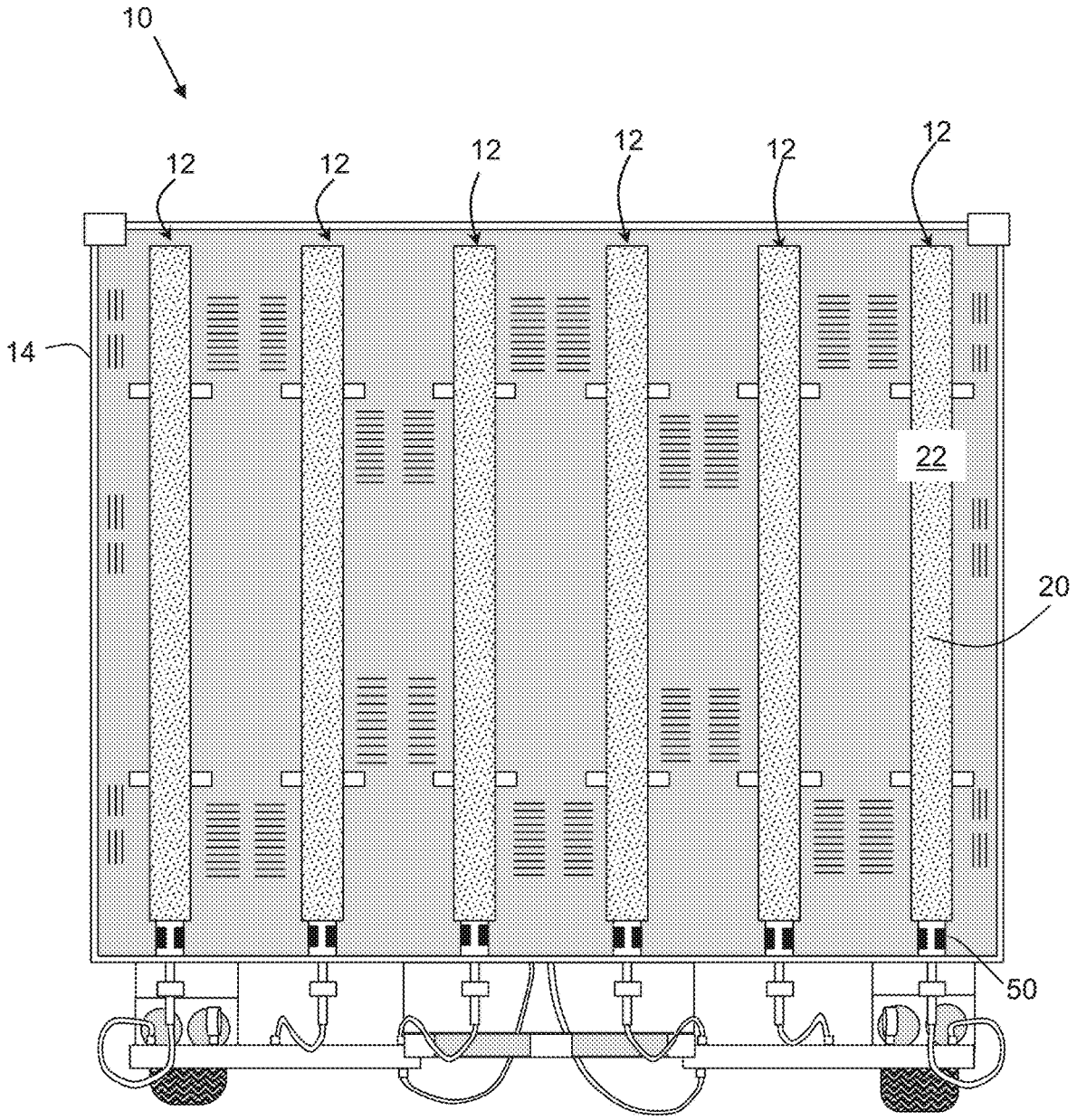
FIG. 1 shows a bottom view of one embodiment of an apparatus for heating asphalt, of the present invention.
Figure 2:
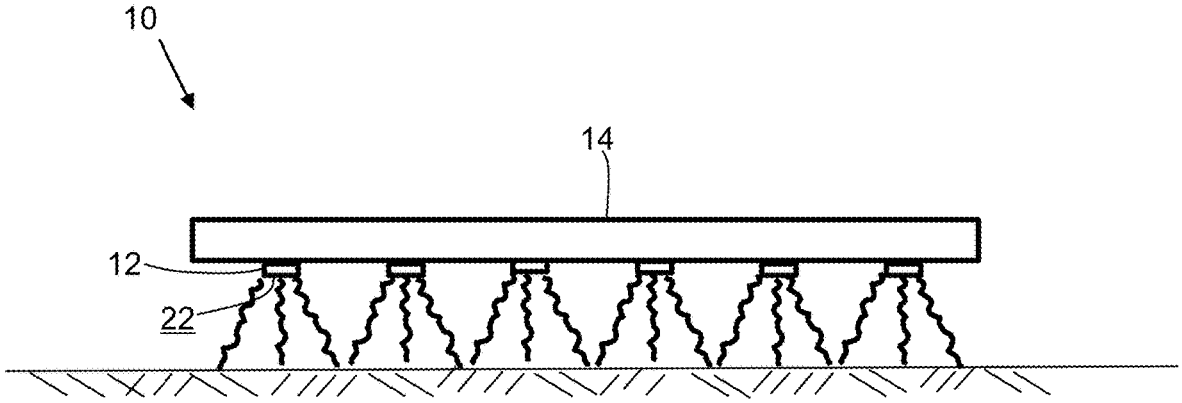
FIG. 2 shows a side view of one embodiment of an apparatus for heating asphalt, of the present invention, which apparatus comprises an array of six heaters.

FIG. 1 shows a bottom view of one embodiment of an apparatus (10) for heating asphalt, of the present invention. In this embodiment, the apparatus (10) includes six heaters (12). The heaters (12) are mounted on a wheeled frame (14) that allows for mobility of the apparatus (10). The frame (14) pivots so that the heaters (12) can be moved between horizontal and vertical orientations. Each of the heaters (12) includes an elongate infrared emitter (20) comprising an elongate emitter surface (22), an elongate burner tube (30) (concealed from view in FIG. 1), and a Venturi tube (50). The apparatus (10) is used with a container (not shown) that stores a gaseous fuel under pressure, and which remains gaseous under ambient conditions. FIG. 2 shows a side view of another embodiment of an apparatus (10) with the six heaters (12) emitting infrared radiation at an asphalt pavement. These and other parts of the apparatus (10) and their use and operation are described in greater detail below.

Infrared Emitter.

The infrared emitter (20) comprises an elongate emitter surface (22) for emitting infrared radiation at the asphalt pavement when the infrared emitter (20) is heated.

All infrared emitters (20) use a glowing metal, ceramic or glass filament or screen to generate infrared emissions, and conventionally use the combustion or oxidation of fossil fuels, or electric resistance to generate the required energy. The temperature of the glowing filament determines the desired wavelength and frequency of the infrared emissions, and the composition of the filament or screen has a bearing on the nitrogen oxides (NOX) emissions and the infrared spectrum. The most stable infrared outputs are generated by electrically generated infrared heat, due to the ease with which voltage, current and resistance can be controlled, but electrical generation is not well-suited to mobile applications because of the capital cost of the equipment and energy input cost.

The elongate emitter surface (22) may be provided in a variety of lengths and widths to achieve energy density desired as well as being able to adapt to existing machinery. In one embodiment, the elongate infrared emitter (20) has a length between about 4 to 12 feet (about 1.2 meters to about 3.7 meters), and preferably between about 5 feet to about 6 feet (about 1.5 meters to about 1.8 meters). In one embodiment, the infrared emitter (20) has a width less than about 6 inches (12.7 centimeters), and preferably between about between about 2.5 inches to about 4 inches (about 6.4 centimeters to about 10 centimeters). In embodiments, the heater (12) has a length-to-width ratio that is at least about 5, and preferably at least about 10. As a non-limiting example, the infrared emitter (20) has a length of about 6 feet (1.8 meters) and a width of about 3 inches (7.6 centimeters) for a length-to-width ratio of about 23.7.

In the embodiments shown in FIGS. 1 and 2, the apparatus (10) has multiple heaters (12). The emitter surfaces (22) are arrayed parallel to each other along their lengthwise directions, and spaced apart from each other in their widthwise directions. In embodiments of the apparatus (10) used for longitudinal joint heating, the emitter surfaces (22) may be arranged in line, in end-to-end relationship with each other along their lengthwise direction. As a non-limiting example, three emitter surfaces (22) may be arranged in this manner. As another non-limiting example, six emitter surfaces (22) may be arranged in three rows of two heaters (12) side by side.

As may be seen in FIG. 2, when placed an appropriate height above the asphalt pavement, the spacing of the emitter surfaces (22) allows for relatively even heating of an entire rectangular area of the asphalt pavement below the apparatus (10). If the emitter surfaces (22) are spaced too closely together, too much heat may be applied to areas of the asphalt pavement where their emitted infrared radiation overlap. Conversely, if the emitter surfaces (22) are spaced too far apart, then too little infrared radiation may be applied to areas of the asphalt pavement between the emitter surfaces (22). As a non-limiting example, where the emitter surfaces (22) have an effective radiating width of between about 2.5 to about 4 inches (about 6.4 centimeters to about 10 centimeters), the preferred centerline to centerline spacing between the emitter surfaces (22) in the widthwise direction may be between about 12 inches to about 20 inches (about 30 centimeters to about 50 centimeters). In a preferred example, where the emitter surfaces (22) have an effective radiating width of about 3 inches (about 7.6 centimeters), the preferred centerline to centerline spacing between the emitter surfaces (22) in the widthwise direction may be about 16 inches (about 40 centimeters), such that an array of 6 parallel emitter surfaces (22) (such as shown in FIG. 2) gives a rectangular heating area which is about 8 feet (about 2.4 meters) in width.

Figure 3A:
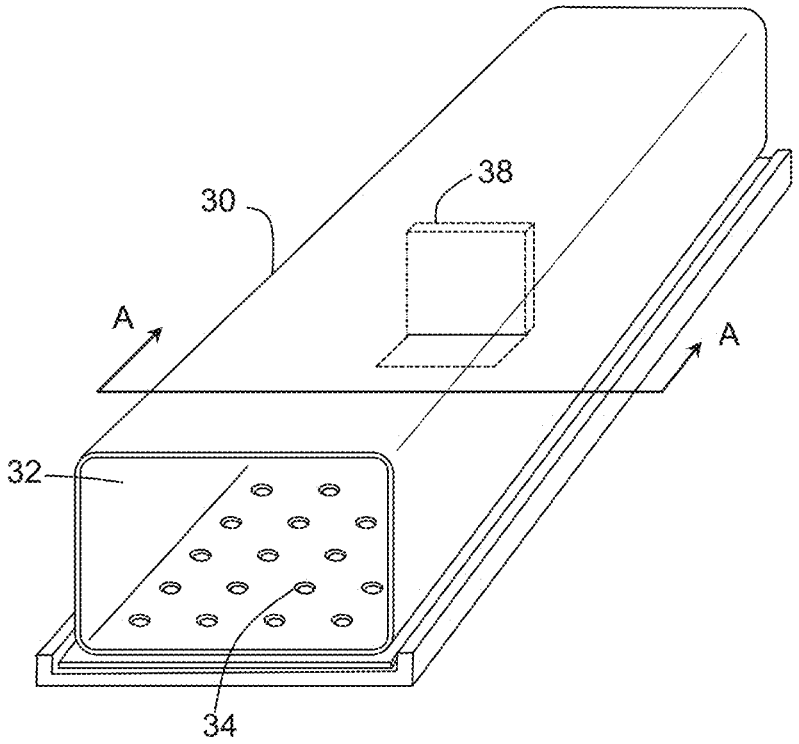
FIG. 3A shows an end perspective view of another embodiment of an assembly of a burner tube and an infrared emitter, as may be used in an embodiment of an apparatus of the present invention.
Figure 3B:
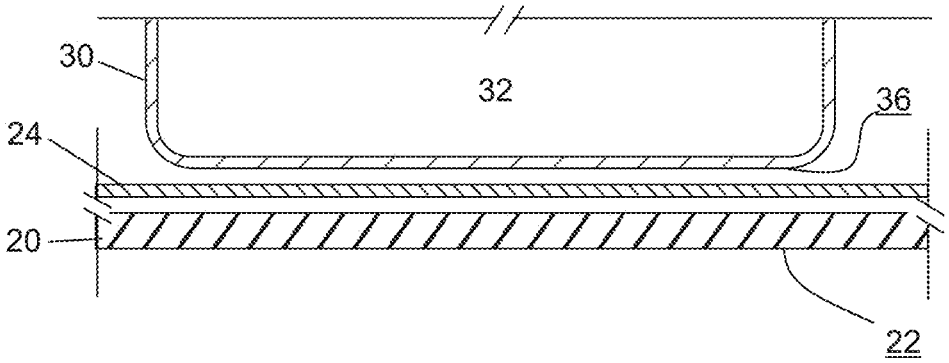
FIG. 3B shows a cross-sectional view of the burner tube and infrared emitter of FIG. 3A along section line A-A of FIG. 3A.

In one embodiment as shown in FIGS. 3A and 3B, the infrared emitter (20) comprises a matrix of stacked, knitted, metal fibers, such as Inconel™ (an alloy comprising nickel, chromium and iron that is resistant to oxidation at high temperatures). In other embodiments, the infrared emitter (20) may comprise other temperature refractory metal alloy, or ceramic fibers. In this embodiment, the matrix of Inconel™ fibers may have a thickness of about 2 millimeters. In this embodiment, the emitter surface (22) may be adapted to be heated to about 1800 degrees Fahrenheit when emitting infrared radiation.

The apparatus (10) may also comprise a support member (24) to stiffen and support the matrix of fibers that make up the infrared emitter (20). In one embodiment as shown in FIG. 3, the support member (24) is in the form of an expanded metal stainless steel sheet provided on the upper surface of the Inconel™ matrix. As known to persons skilled in the art of metal fabrication, an expanded metal sheet is made by creating multiple slits in the sheet, and then stretching the sheet to create the diamond pattern of apertures. The support member apertures permit flow of heated combustion gases to the Inconel™ matrix.

Burner Tube.

In one embodiment as shown in FIGS. 3A and 3B, the burner tube (30) has a rectangular transverse cross-sectional shape. In other embodiments, the burner tube (30) may have other transverse cross-sectional shapes such as square, octagonal or other polygonal shapes. In this embodiment, the burner tube (30) has walls made of stainless steel plate (e.g., Society of Automotive Engineers (SAE), type 316 stainless steel). The burner tube (30) defines a burner tube interior (32) for distributing an air-fuel mixture. In this embodiment, the lower wall plate of the burner tube (30) defines a plurality of the burner tube apertures (34) for distributing the air-fuel mixture a burner tube (30) lower outer surface that is disposed opposite to and spaced apart from the infrared emitter (20). In this embodiment, the burner tube apertures (34) are circular in shape, have a diameter of about 4 millimeters, and are spaced center-to-center at about 15 millimeters in both the lengthwise and widthwise directions of the burner tube (30). As such, the lower wall plate forms a diffuser that allows for relatively even distribution of the air-fuel mixture at the burner tube outer surface (36). In this embodiment, the burner tube (30) and the infrared emitter (20) are coupled together such that the burner tube outer surface (36) is disposed opposite to and spaced apart from an upper surface of the infrared emitter (20). The space between the burner tube outer surface (36) and the upper surface of the infrared emitter (20) allows for combustion of the air-fuel mixture exiting the burner tube interior (32) through the burner tube apertures (34).

In the embodiment shown in FIGS. 3A and 3B, the Venturi tube (50) supplies fuel to the burner tube interior (32) through an end opening, such that the resulting air-fuel mixture travels lengthwise in the burner tube interior (32) towards the opposite closed end of the burner tube (30). In this embodiment, a baffle (38) is provided in the burner tube interior (32) to create turbulence in the flow of the air-fuel mixture, which may help to avoid pressure build up at the closed end of the burner tube (30). In this embodiment, the baffle (38) is in the form of a stainless steel plate that extends vertically from the inside of the lower wall plate of the burner tube (30), at about the midpoint of the length of the burner tube (30). In this embodiment, the stainless steel plate has an area of about 50 percent of the cross-sectional area of the burner tube interior (32).

Venturi Tube.

Figure 4:
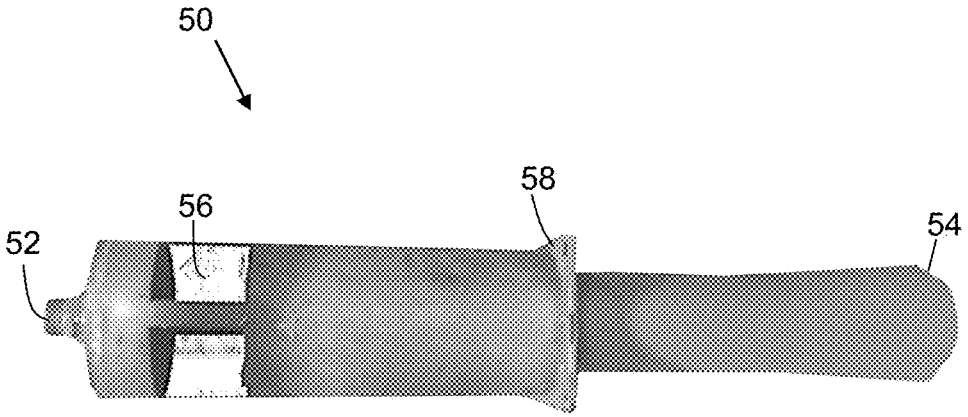
FIG. 4 shows a side view of an embodiment of a Venturi tube, as may be used in an embodiment of an apparatus of the present invention.
Figure 5:
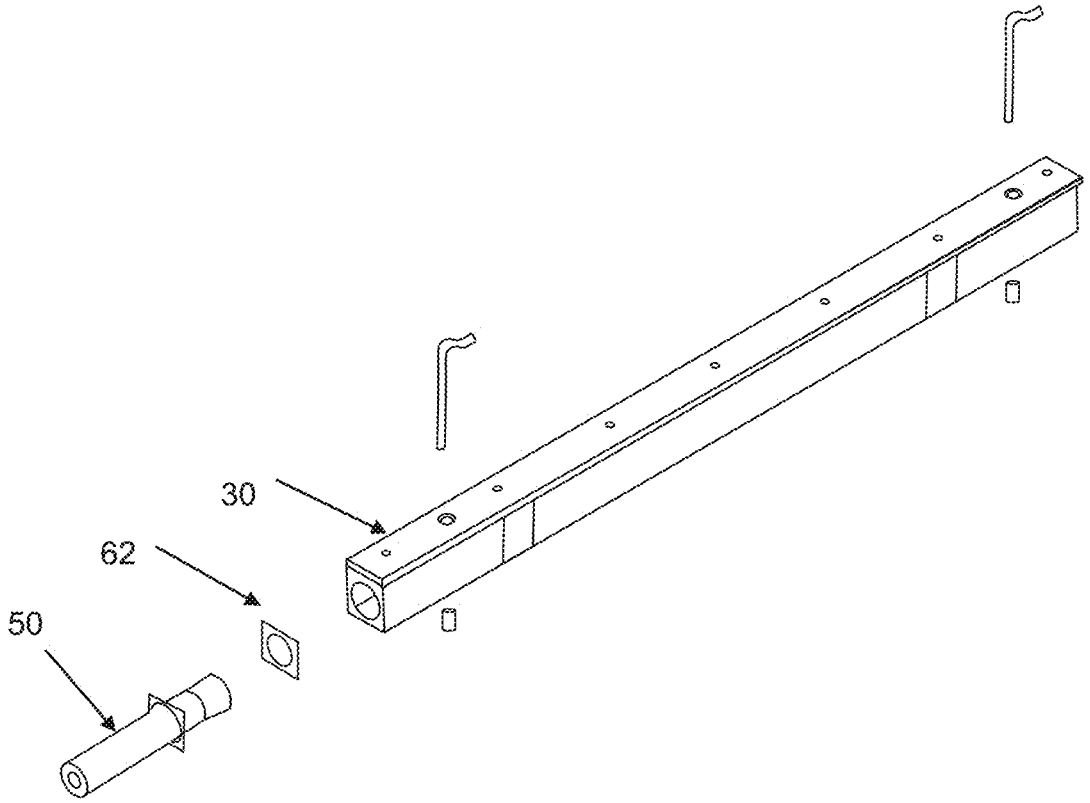
FIG. 5 shows an exploded perspective view of one embodiment of an assembly of a burner tube and a Venturi tube, as may be used in an embodiment of an apparatus of the present invention.
Figure 6:
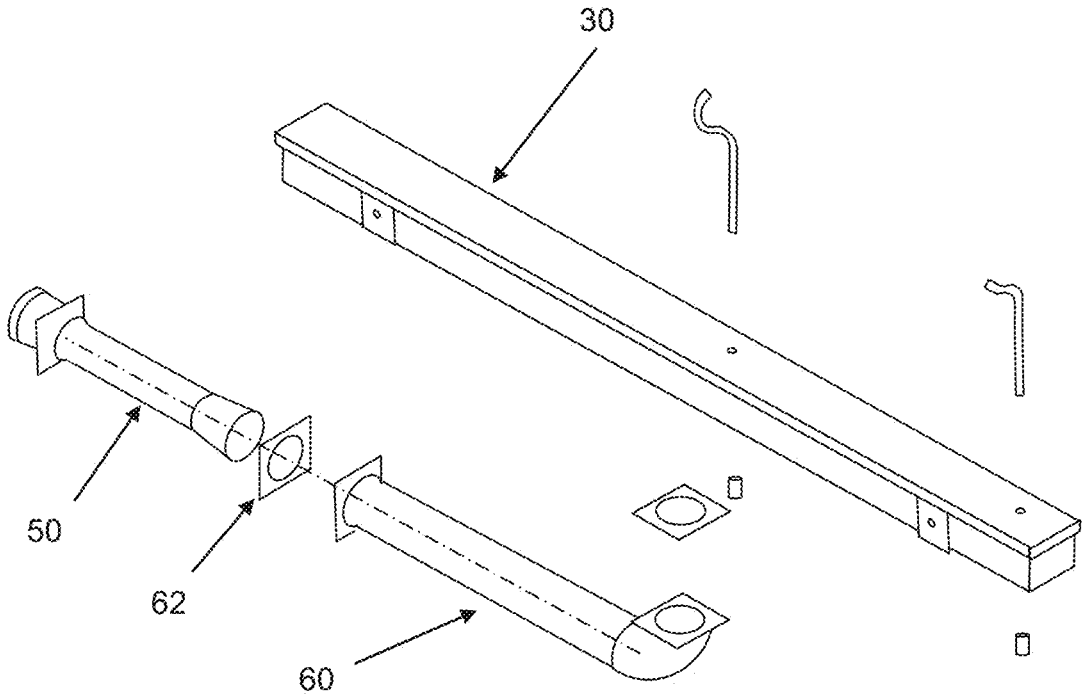
FIG. 6 shows an exploded perspective view of another embodiment of an assembly of a burner tube, a Venturi tube and a manifold, as may be used in an embodiment of an apparatus of the present invention.

The Venturi tube (50) mixes fuel from the container with the air to create an air-fuel mixture, and supplies the air-fuel mixture to the burner tube interior (32). In one embodiment as shown in FIG. 4, the Venturi tube (50) is provided in the form of a Venturi eductor nozzle extending from an inlet (52) to an outlet (54). In use, the inlet (52) is connected to a line that supplies the gaseous fuel from a container. The nozzle defines suction inlets (56) allowing intake air to be drawn into the Venturi tube (50) and mixed with the gaseous fuel to create an air-fuel mixture. The nozzle also defines a bearing plate (58) that engages the end of a burner tube (30) when the outlet (54) is inserted into an end inlet of the burner tube (30) (such as shown in one embodiment in FIG. 5), or an end opening of a manifold (60) that conveys the air-fuel mixture to an inlet of the burner tube (30) formed between its ends (such as shown in one embodiment in FIG. 6). A sealing gasket (62) may be provided to prevent loss of the air-fuel mixture between the bearing plate and the end of the burner tube (30) or the end of the manifold (60) as the case may be.

In use, the Venturi tube (50) down regulates the pressure of the gaseous fuel from the container to the burner tube interior (32). As a non-limiting example, the Venturi tube (50) may down regulate the supply pressure of gaseous propane fuel stored in a container under pressure in the range of about 2 psi to about 65 psi (about 13.8 kPa to about 450 kPa) to about 2 psi (about 13.8 kPa) in the burner tube interior (32). As the combustion process is regulated by the available fuel pressure and the Venturi tube (50), the apparatus (10) does not require any powered mechanism to pressurize the fuel supplied from the container to the burner tube interior (32). Further, the apparatus (10) does not require any electrical power, except possibly for a spark ignition source on startup and safety controls.

The heater (12) may be used to burn a gaseous hydrocarbon fuel such as natural gas, methane, ethane, propane, butane or other fuels that are gaseous under ambient conditions. It is preferable to use relatively clean burning fuels, such as natural gas or propane. By appropriate selection of the Venturi tube (50) configuration and regulation fuel supply pressure from the container (e.g., by use of a regulating valve in the line between the container and the inlet of the Venturi tube (50)), the pressure of the air-fuel mixture in the burner tube interior (32) can be controlled as needed, which in turn allows for modulation of the temperature of the combustion gases and the resultant temperature of the infrared emitter (20). Accordingly, the apparatus (10) may be adapted in this manner to burn a variety of different types of fuel.

Induction Tubes.

In one embodiment, the intake air for combustion may be preheated in induction tubes using waste-heat radiated off the back of the burner chamber, which assists in increasing heater (12) efficiency. Further, the heated air may assist in atomizing and evaporating any oils or liquids carried in the gaseous fuel, which may help to prevent clogging of the infrared emitter (20) when it comprises a matrix of metallic fibers.

Reflectors.

If necessary or desired, the view-factor of a heater (12) or array of heaters (12) may be further controlled by reflectors.

Use of Apparatus.

In exemplary uses, the apparatus may be used to heat asphalt pavement during repair operations or new installation. In other exemplary uses, the apparatus may be used to remediate most asphalt or pavement deficiencies or recycled asphalt pavement (RAP), or generally any in heating of virtually any silica-based minerals. As non-limiting examples, the apparatus may be used in bridge-deck concrete/asphalt heating for crack-detection. In other applications, the apparatus may be used in controlled thermal treatment of contaminated soils and materials without incineration, which may avoid formation of harmful or undesirable combustion products.

Principles of Infrared Heating of Asphalt.

It is a goal of the present invention to maximize the difference in temperature between the heat emitting surface, while substantially balancing heat flux in the asphalt. Heat flux in the asphalt behaves in the manner described below.

Heat or thermal energy is the result of molecular motion, and can be transferred by radiation, convection or conduction, or some combination of these. All objects emit thermal radiation as light or electromagnetic radiation. All objects may absorb thermal radiation. When the absorption of energy balances the emission of energy, the temperature of an object stays constant. If the absorption of energy is greater than the emission of energy, the temperature of an object rises. If the absorption of energy is less than the emission of energy, the temperature of an object falls.

Conduction is the transference of thermal energy by the physical collision of molecules. Conduction occurs when two substances at different temperatures are in direct contact with each other. Heat flows from the warmer to the cooler substance until they are both at the same temperature. At the place where the two object touch, the faster-moving molecules of the warmer substance collide with the slower moving molecules of the cooler substance, and give up some of their energy to the slower molecules. The slower molecules gain more thermal energy and collide with other molecules in the cooler object. This process continues until heat energy from the warmer object spreads throughout the cooler object. Solids are better conductor than liquids and liquids are better conductor than gases.

Convection is the result of warmer fluids moving as a result of their reduced density. It does not play any significant role in the present invention.

Common construction materials absorb infrared radiation in the 2 to 20 micron wavelength range. Bodies heated to about 1700 degrees Fahrenheit (about 925 degrees Celsius) emit infrared radiation with a wavelength between about 0.75 to about 2.4 microns. At higher temperatures, at about 2000 degrees Fahrenheit (about 1100 degrees Celsius), bodies generate a higher percentage of infrared energy but some visible light in the 0.8 micron wavelength range becomes visible.

Darker bodies are more efficient emitters and absorbers of infrared energy. Thus the darker the pavement surface, the faster it will absorb and radiate energy. As a result older pavement surfaces, which tend to be greyer or lighter in color than newer asphalt, do not absorb heat as quickly, or radiate as quickly as newer darker colored pavement. The closer the natural frequency of vibration and wavelength is to the molecules in the target substance, the higher the rate of conversion from infrared energy to sensible heat energy.

Radiant transmission of heat is a surface phenomenon in opaque bodies such as asphalt pavement. In other words, the conversion of radiant energy to heat energy is due to the interaction between the infrared radiation and the surface of the target. This conductance, known as thermal boundary conductance, is due to the differences in electronic and vibrational properties between the contacting materials. This conductance is generally much higher than thermal contact conductance. The higher the temperature of the infrared, the higher the rate of vibration (frequency) the higher the rate of conversion from infrared to sensible heat.

Infrared heaters are commonly used in infrared modules (or emitter banks) combining several heaters to achieve larger heated areas. Infrared heaters are usually classified by the wavelength they emit. Near infrared (NIR) or short-wave infrared heaters operate at high filament temperatures above 3272 degrees Fahrenheit (1800 degrees Celsius) but their peak wavelength is well below the absorption spectrum for asphalt binder, making them unsuitable for asphalt repair work. They are well suited for heating of silica where a deep penetration is needed, but that is only a part of the solution for successful asphalt pavement heating. Medium-wave and carbon (CIR) infrared heaters operate at filament temperatures of around 1832 degrees Fahrenheit (1000 degrees Celsius). They reach maximum power densities of up to 60 $kW/m^2$ (medium-wave) and 150 $kW/m^2$ (CIR). The flame temperature is a function of the speed of combustion, which is in turn a function of the volume of the flame envelope. In other words, the higher the diffusion of the fuel gases, the faster they burn, the higher the flame temperature and the temperature of the emissive element.

Infrared asphalt pavement heating is the combination of three processes, and it is preferred that these three processes be in balance in order to transfer the heat from the infrared emitter to a point approximately two or three inches below the pavement surface, without burning the surface layer and in a safe amount of time.

The first process involves transfer of radiant energy from source to target, without contact or loss. This delivery to the surface is a function of surface absorbency, smoothness, color, age, composition, reflectivity and the ability to modulate burner output to match surface conditions. An asphalt pavement is not homogeneous in terms of spectral composition and there is little advantage to being wavelength-selective in choosing the exact emitter temperature. Based on the mix at surface between exposed aggregate and binder, a wavelength of about 2.3 microns, which corresponds to an emitter temperature of about 1800 degrees Fahrenheit, has been found to yield suitable results.

The second process involves thermal boundary conductance, or the conversion of radiant energy to heat energy at the boundary layer via absorption and interaction between radiant energy and the asphalt molecules.

The third process involves conduction of heat from the surface boundary layer to material beneath the surface. Because the thermal conductivity of the aggregate in the asphalt (95% by volume) is 3 to 4 times higher than the asphalt binder, the greatest proportion of heat both in terms of quantity and speed, is carried by the aggregate. The aggregate is entirely enveloped by binder, and heat passes alternatively from binder to aggregate all the way down to the target level, which may be about 2 to 3 inches (about 5 to 8 cm) below surface.

Another process at work is the re-radiation of heat from the asphalt pavement surface. This phenomenon may have a substantial impact, not so much on the delivery of heat energy to the target depth, but on the quality of the binder at the surface. As the heated surface temperature rises, the surface itself becomes a heat radiator, albeit of highly dispersed infrared energy. In one embodiment, this energy may be reflected back to the asphalt surface using heat shields or reflectors, which may speed up the overall process, resulting in shorter dwell times, and thus minimizing loss of the volatile content at the surface. Reflectors for this purpose may not be required or desirable for all applications.

All infrared heaters will heat asphalt paving in time, but in order to for this to happen within a productive time-frame and without damaging the pavement, the different heating processes are preferably substantially in equilibrium. This equilibrium needs to be achieved in the boundary layer where the net rate of energy entering the boundary layer, the rate of conversion from radiant to heat energy and the rate of heat leaving the boundary layer is substantially in balance.

Equilibrium may be difficult to achieve due to the slow rate at which heat conducts through the asphalt (diffusivity). The coefficient of heat diffusion for asphalt varies with composition, but averages $0.16\times10^{-6}$ $m^2$/second, which translates into a practical rate of 24 mm/minute in one direction. Volatile components of the asphalt are lost as temperature rises, and longer exposure to heat means greater loss of volatiles. Accordingly, it is preferred to deliver as high-energy as possible a parcel of energy in the shortest time possible, without overheating or immolation of the surface, and irreparable damage of the binder in the boundary layer and the pavement surface. Accordingly, in some embodiments of the present invention, infrared energy is applied to provide maximal amounts of heat in an effort to reduce the total heating time required, but without overheating the surface.

An important determinant in achieving the 3-part equilibrium is source temperature (the temperature of the infrared emitter) which makes possible high temperature differentials during the conduction phase. Asphalt binder starts to evaporate volatile compounds at about 200 degrees Fahrenheit, and which will actively boil off at 450 degrees Fahrenheit, attain its flashpoint at 550 degrees Fahrenheit, and will flame spontaneously at 650 degrees Fahrenheit. Therefore, successful pavement heating takes place with the surface temperature reaching 350-400 degrees Fahrenheit, but not for sustained periods.

Radiant energy is expressed by the Stefan-Boltzmann Law as follows:

$$Q=kT^4$$

where Q is total emissive power in Watts/$cm^2$, k is the Stefan-Boltzmann constant, and T is source temperature in degrees K (absolute temperature). In order to understand which of the parameters are important in high-intensity infrared heating, the following general equation for heat-transfer illustrates the should be considered between the source and the target (the boundary-layer)

$$Q=(VF)\times(ES)\times(AF)\times k\times(TS4-TT4),$$

where:

- Q is the heat-flux density, or the amount of heat being absorbed in a certain area within a fixed time limit, expressed in BTU per square inch per second or in watts per square meter. Multiplying "Q" by time will give the amount of heat in BTUs or kilo Joules transferred to the pavement surface for redistribution via conduction;
- VF=view factor (normally between 0 and 1), The view factor (VF) is a feature only applicable to a point source of infrared, (versus blanket source) and allows the amount of radiant energy (the flux-density) impinging the target area, to be matched to the pavement color, texture, smoothness, degree of wear, which directly effects the absorption factor. Varying the height has an inverse effect on the flux density and this allows the heat entering the boundary layer to be matched with that leaving the boundary layer. Machines with ceramic blankets or ceramic-fiber curtains do not have this capability since the flux does not change with distance between source and target, and no loss occurs during the transmission process. Apparatuses of the present invention have a linear point source and VF can be reduced from 1 to 0.5 to halve the flux density. This becomes a very important feature when absorption factors vary as much as it does with asphalt pavement;
- ES is the emissivity of the emitter (source) and is a function of the emitter material and texture;
- AF is the absorption factor of the target, which is a function of color, texture, smoothness, etc. AF is that property of the pavement surface which determines how responsive the surface is to the absorption of infrared flux. The darker the surface, the faster it absorbs infrared, the lighter it is, the more it reflects it. Older pavement has more worn asphalt exposed, which, lightens it and reduces is receptiveness to infrared energy. Similarly the texture has an impact: smoother surfaces tend to reflect more infrared and rougher surfaces absorb more. This factor, called the absorption coefficient averages out at about 0.81 for normal aged pavement A further phenomenon, and one which has a significant impact on residence times, is the fact that as the pavement surface heats up, it starts to radiate more heat, making flux density an important element of infrared heating. In short, the emission of radiation is not the emission of heat. It is only when a body absorbs radiation, that it is converted into heat. When the hotter radiant source is removed, AF becomes EF and the asphalt radiates heat outwards.

Therefore, apparatuses of the present invention may comprise reflectors to control the view factor during heating, which become reflectors for re-radiated heat from the asphalt. Infrared heat reflectors may have highly polished reflective surfaces.

Temperature differential between source and target, (TS-TT) is thus an important determinant of effective infrared application to pavement heating applicable to both the radiant and the conductive parts of the process.

The combination of high source temperature, and resultant high flux densities, combined with the ability to modulate the flux with a variable VF, to match the target AF, whilst maintaining high temperature differentials between source and target, enables heating varying pavement surfaces without damaging the asphalt.

In the radiant phase of bringing heat to the boundary layer, temperature (in degrees Kelvin) to the fourth power ($T^4$) has a significant effect on the flux density, or the rate at which heat is transmitted to the asphalt surface. If all other factors, such as EF, AF, VF are constant, the equation looks like this:

$$Q\propto T^4$$

In other words, the flux density of radiant energy is proportional to the absolute temperature of the source to the 4th power. However, due to surface color and texture, only a portion of the radiant energy (the usable energy, $Q_{useable}$) is absorbed into the surface and converted to heat by molecular action in the boundary layer, with the balance being reflected, expressed as follows:

$$Q_{useable}=Q_{delivered}-Q_{reflected}$$

A heater of the present invention, operating at about 1800 degrees Fahrenheit (1255 K) results in very different heat energy flow compared to a prior art machine at 1450 degrees Fahrenheit (1060 K) average emitter temperature. The flux density is 2.3 times higher ($1255^4/1060^4=2.3$). Thus, the higher temperature burner delivers 230% of the heat flux of a machine with a source temperature of 1450 degrees Fahrenheit, and similarly, 170% of a ceramic fiber machine which operates at about 1600 degrees Fahrenheit.

However, in order to avoid surface damage with such high heat flux, the view factor (VF) of an infrared machine can be changed to match the flux density of the machine to the absorption capability of the asphalt surface being treated, without reducing the temperature of the flux. Thus, older, greyer oxidized pavement and newer, blacker pavement, can both be effectively heated without surface combustion by altering the VF. New pavement has an absorption factor (AF) three to four times higher than old pavement and can absorb proportionally as much heat in a given time period.

High flux temperature also affects the conversion of radiant to heat energy in the boundary layer:

$$T=Q\times A\times t/M\times Cp$$

where T=temperature rise of the boundary layer, A is the area, t is the dwell-time, or time of exposure to infrared emission, and Cp is the specific heat of the asphalt pavement conglomerate.

In normal infrared heating applications, the temperature rise in the target substance is determined by the heating dwell-time "t", but asphalt pavement is different in that dwell time is detrimental to pavement life, because of the loss of maltenes (volatiles) in the binder. The volatile components reach boiling point at about 450 degrees Fahrenheit. Thus, the shorter the dwell-time, the less binder is lost in the boundary layer. This can be achieved only by the temperature difference between source and target, which should be as large as possible.

In order to explore the significance of this number, we need to explore the third part of the heating process, namely conduction of heat away from the boundary layer. TS−TT determines the rate at which heat is transmitted into the sub-surface asphalt by conduction from the boundary layer to the asphalt (the heat leaving the boundary layer), as defined by the formula:

$$Q=U\cdot A(T1-T2)$$

Where Q is the heat-flux density in W, U is the overall heat transfer coefficient in W/(m2·K), and A is the area subjected to infrared energy in square meters.

Interpretation.

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. Embodiments were chosen and described in order to best explain the principles of the invention and the practical application, and to enable others of ordinary skill in the art to understand the invention for various embodiments with various modifications as are suited to the particular use contemplated.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

The invention claimed is:

1. An apparatus for heating asphalt, the apparatus for use with a container storing a gaseous fuel under pressure, the apparatus comprising at least one heater, wherein each of the at least one heater comprises:

(a) an elongate infrared emitter comprising an elongate emitter surface for emitting infrared radiation at the asphalt when the infrared emitter is heated wherein the infrared emitter comprises metallic fibers comprising an alloy comprising nickel, chromium, and iron;

(b) an elongate burner tube coupled to the infrared emitter, wherein the burner tube defines a burner tube interior for distributing an air-fuel mixture to a plurality of burner tube apertures for distributing the air-fuel mixture over a burner tube outer surface disposed opposite to and spaced apart from the infrared emitter;

(c) a support member for supporting the infrared emitter, wherein the support member is disposed between the burner tube outer surface and the infrared emitter, and defines a plurality of support member apertures permitting gas flow from the burner tube outer surface to the infrared emitter; and (d) a Venturi tube for mixing the fuel from the container with air to create the air-fuel mixture, and supplying the air-fuel mixture to the burner tube interior.

2. The apparatus of claim 1, wherein the support member comprises an expanded metal sheet.

3. The apparatus of claim 1, wherein the Venturi tube supplies the air-fuel mixture to the burner tube interior through an end opening of the burner tube.

4. The apparatus of claim 1, wherein the Venturi tube supplies the air-fuel mixture to the burner tube interior through an opening of the burner tube between the ends of the burner tube.

5. The apparatus of claim 1, further comprising a baffle disposed in the burner tube interior.

6. The apparatus of claim 1, wherein the at least one heater comprises a plurality of heaters.

7. The apparatus of claim 6, wherein the elongate emitter surfaces are arranged parallel to each other along their lengthwise direction, and spaced apart from each other in the widthwise direction.

8. The apparatus of claim 6, wherein the elongate emitter surfaces are arranged in line and end-to-end relationship with each other along their lengthwise direction.

9. The apparatus of claim 1, further comprising an induction tube for supplying intake air to the burner tube interior, wherein, in use, the induction tube is heated by waste-heat radiated from the burner tube to pre-heat the intake air supplied to the burner tube interior.

10. The apparatus of claim 1, further comprising a reflector for adjusting a view factor of the emitter surface.

11. A method for heating asphalt, the method comprising the steps of:

(a) supplying a gaseous fuel stored under pressure in a container and air through a Venturi tube to create an air-fuel mixture in a burner tube interior;

(b) distributing the air-fuel mixture from the burner tube interior through burner tube apertures over a burner tube outer surface disposed opposite to and spaced apart from an infrared emitter; and (c) combusting the distributed air-fuel mixture to heat the infrared emitter, whereupon an emitter surface of the infrared emitter emits infrared radiation at the asphalt;

(d) wherein the infrared emitter comprises a matrix of metallic fibers, supported by a support member disposed between the burner tube outer surface and the infrared emitter, and defining a plurality of support member apertures permitting gas flow from the burner tube outer surface to the infrared emitter.

12. The method of claim 11, further comprising the step of regulating a pressure at which the fuel is supplied from the container to the Venturi tube.

13. The method of claim 11, wherein the metallic fibers comprise an alloy comprising nickel, chromium, and iron.

14. The method of claim 11, wherein the infrared emitter is heated to a temperature of at least about 1800 degrees Fahrenheit.

15. The method of claim 11, further comprising the step of pre-heating intake air supplied to the burner tube interior with waste-heat radiated from the burner tube.

16. The method of claim 11, further comprising the step of using a reflector for adjusting a view factor of the emitter surface.

* * * * *